United States Patent [19]

Thompson

[11] 4,174,832

[45] Nov. 20, 1979

[54] FRICTION TYPE EXERCISE DEVICE

[76] Inventor: Charles W. Thompson, R.R. 2, Box 24A, Columbia, Ill. 62336

[21] Appl. No.: 739,627

[22] Filed: Nov. 8, 1976

[51] Int. Cl.[2] ..... A63B 21/00

[52] U.S. Cl. ..... 272/133; 272/DIG. 5; 272/140

[58] Field of Search ..... 272/131, 133, 136, 140, 272/142; 188/65.1, 65.3, 65.4, 65.5; 73/379, 380; 242/147; 66/146; 35/19

[56] References Cited

U.S. PATENT DOCUMENTS

| | | | |
|---|---|---|---|
| 2,605,055 | 7/1952 | Scott et al. | 242/147 R X |
| 3,544,105 | 12/1970 | Latta | 272/133 |
| 3,640,530 | 2/1972 | Henson et al. | 272/132 |
| 3,674,261 | 7/1972 | Krug | 272/133 |
| 3,885,789 | 5/1975 | Deluty et al. | 272/133 |
| 4,010,948 | 5/1977 | Deluty | 272/133 |

*Primary Examiner*—Richard C. Pinkham
*Assistant Examiner*—William R. Browne
*Attorney, Agent, or Firm*—Rogers, Eilers & Howell

[57] ABSTRACT

An exercise device has a cord contained in a housing with a handle on the cord to pull it out of the housing. Resistance is developed by sliding friction between the cord and the housing and between the cord and a spool in the housing. The device has independent adjustment for controlling the friction between the cord and the housing and the spool friction. A recoil wheel retracts the cord.

10 Claims, 10 Drawing Figures

FIG. 4.
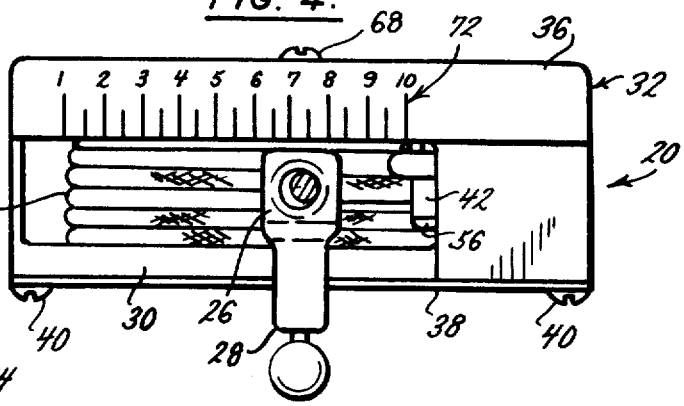
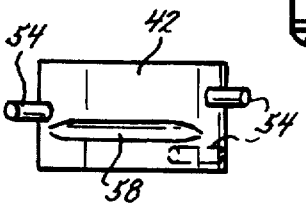
FIG. 10.
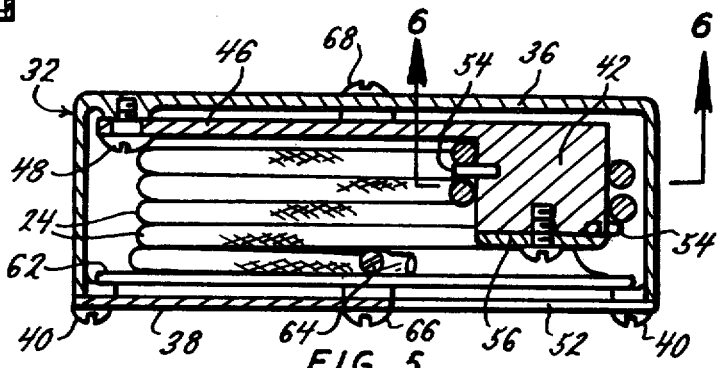
FIG. 5.
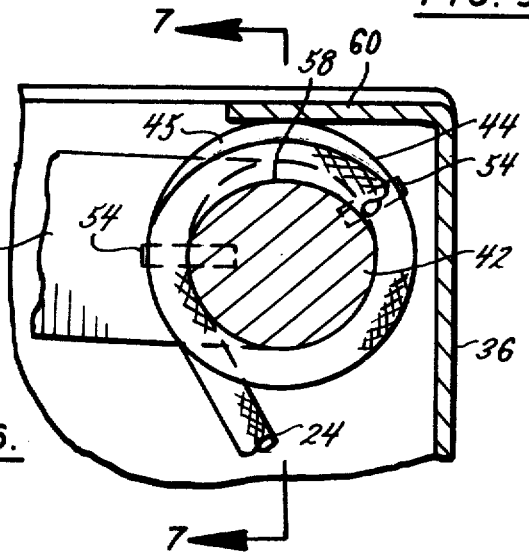
FIG. 6.
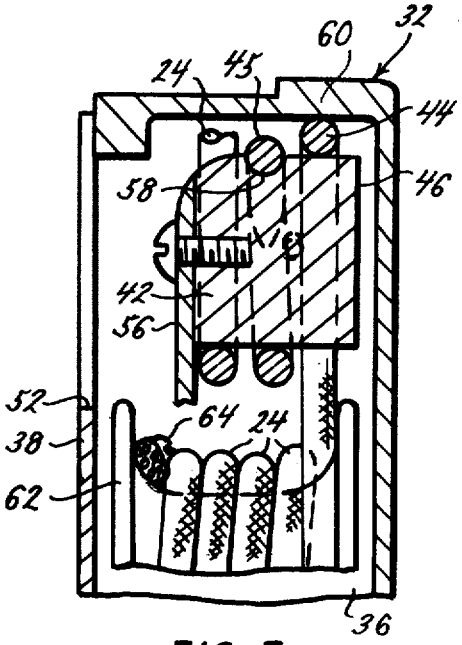
FIG. 7.
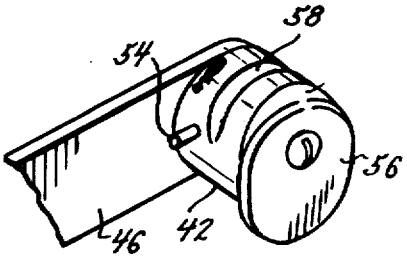
FIG. 8.
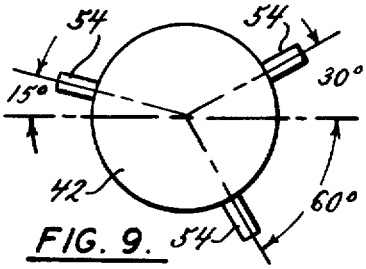
FIG. 9.

FRICTION TYPE EXERCISE DEVICE

BACKGROUND AND SUMMARY OF THE INVENTION

Exercise devices using a rope to lift weights have been used by gyms and exercise rooms for many years. They are usually installed in a wall or other heavy support structure and are operated by pulling a handle or ring attached to an end of a rope which is connected at its other end to weights and operates through a series of pulleys. There is usually some structure at the end of the rope to allow the weight to be increased or decreased, as desired. As these devices require pulleys and weights of considerable mass, fixed installations are required which can be very expensive.

Over the past several years, various developments have been made to eliminate the requirement for a fixed installation while retaining the benefits of a rope pulling exercise device. These newer devices eliminate the pulley and weight structure by subjecting the rope to a variable resistance through a gearing arrangement or friction applying structure. As the variable resistance structure can be quite simple and small, much cheaper portable rope pull exercisers have become feasible.

A prior patented friction device has a hollow tube which is rotatable about a cast eyelet and shaft assembly. The rope enters the bottom of the tube, wraps around the shaft, loops through the eyelet, wraps around the shaft again and exits through another hole in the bottom. Resistance is placed on the rope by varying the length of rope wrapped around the shaft. The eyelet is used to attach the device to a support opposing the operator's exerted force on the rope. The operator pulls the rope back and forth through the device by handles attached at either end of the rope.

There are several disadvantages to the prior device. It is necessary that the operator exercise both arms or legs at the same time or else he is forced to pull the rope all the way through with one handle and then change handles to retract the rope. This is very inconvenient if it is desired to exercise only one arm or leg. It is also difficult to locate the operator at exactly the right distance from the device so that the muscle being exercised is exerted at the correct angle and through the correct arc about the body.

Applicant has succeeded in developing a device which provides the convenience and benefits of a rope pull exercise device while eliminating the problems inherent in prior devices. Applicant's device has only one end of the rope available for exercise and the other end is attached to a recoil wheel. The resistance is disengaged when the pull force is released from the handle, permitting rapid recoil action. This allows the operator to exercise one limb at a time and to perform exercises requiring rapid repetitions. Positioning of the device is not critical.

While most other rope exercisers have only one adjustment for the resistance, applicant's invention may have two. One adjustment may select a base level and the other may be graduated to add small increments of resistance as the operator develops the particular muscle or muscle group he is exercising. One or more base levels may be provided, as desired, giving a very wide range of resistance levels.

Applicant's invention can be more fully understood after reviewing the drawings and the preferred embodiment.

DESCRIPTION OF THE DRAWINGS

FIG. 4 is taken along the lines 4—4 in FIG. 3 and is a top view of the device;

FIG. 5 is taken along lines 5—5 in FIG. 3 and is a cut away top view of the device;

FIG. 6 is taken along lines 6—6 in FIG. 5 and is an exploded detail of the spool and the housing;

FIG. 7 is taken along lines 7—7 in FIG. 6 and is an exploded cut away side view of the spool;

FIG. 8 is a broken plan view of the spool and support arm.

FIG. 9 is a side elevated view of the spool detailing the guide pins;

FIG. 10 is a top view of the spool and guide pins taken along line 10—10 in FIG. 9.

DESCRIPTION OF THE PREFERRED EMBODIMENT

Figure 1:
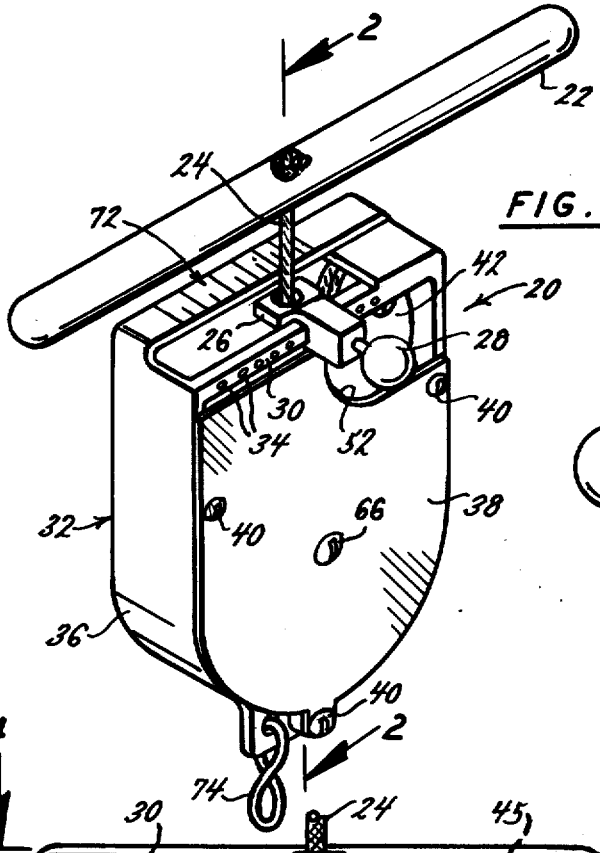
FIG. 1 is an elevated oblique plan view of the device.
Figure 2:
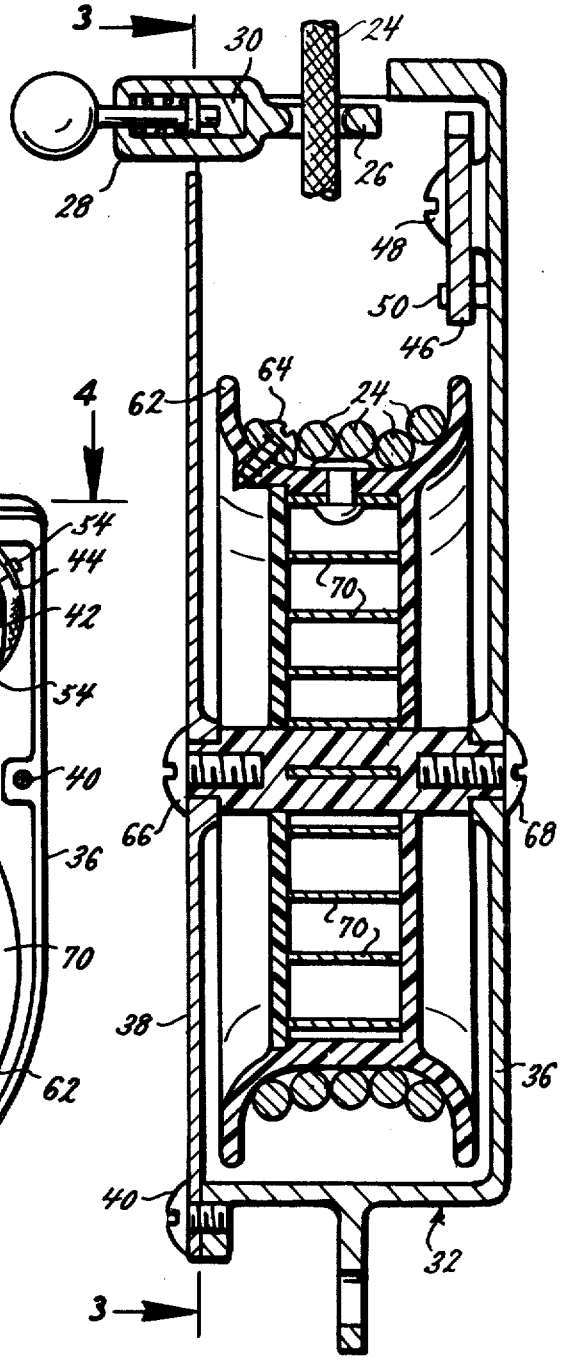
FIG. 2 is taken along lines 2—2 of FIG. 1 and is a cut away side view of the device.

Referring to the drawings, the exercise device 20 consists of a handle 22 attached to the end of a cord 24 which passes through an eyelet 26 of the detent assembly 28 which is mounted on a slider bar 30 formed in the top of a housing 32. Position holes 34 in the slider bar 30 allow the detent assembly 28 to be located at various positions along the slider bar 30, thereby varying the resistance applied to the cord 24, as described herein. A sliding set screw assembly or other similar device could be used in place of holes 34 and detent 28, if desired. The housing 32 consists of a case 36 with a front cover 38 held in place by three screws 40. The housing case 36 can be constructed of steel or any other material strong enough to withstand the stress developed during use while the housing cover 38 can be plastic or any other light weight material.

The cord 24 extends through the eyelet 26 and wraps around a spool 42 between one and three or more times to form loops 44 on the spool 42. The spool 42 is made of nylon, stainless steel, or any material suitable for withstanding the compressive and shear force and is mounted on one end of a support arm 46 which is pivotably mounted to the inside back of the housing case 36 by a screw 48. The support arm 46 may be formed of the same material as the spool 42 and may even be one continuous piece with the spool 42. A limit pin 50 extends into the housing 32 from the inside back of the housing case 36 and restricts the motion of the support arm 46 about screw 48. The limit pin 50 could be placed in any convenient location including closer to the spool end of the support arm 46. An opening 52 in the housing cover 38 permits access to the spool 42 for changing the number of loops 44 around the spool 42 without removal of the front cover 38. One or more guide pins 54, a retainer plate 56, and one or more recess slots 58 hold the cord 24 on the spool 42 and prevent the cord 24 from becoming tangled during operation of the device. In addition, the recess slots 58 reduce the upward extension of the second and third loops 45 of cord 24 to prevent their being squeezed between the spool 42 and the inside of the top of the case 36 during operation.

Applicant has found that three guide pins 54 and one recess slot 58 spaced approximately as shown in FIG. 9 and FIG. 10 avoid fouling of the cord 24 when one or two loops 44 are used in the exerciser 20. A slider plate 60 may be provided in the top of the case 36 to vary the resistance applied to loop 44 of the sliding cord 24, by housing 36 and plate 60, as is explained herein.

After forming loops 44 and 45 around the spool 42, the cord 24 wraps around the recoil wheel 62 and is attached thereto by a screw 64 or other similar fastener. The recoil wheel 62 is rotatably secured to the case 36 by means of a front screw 66 extending through the cover 38 and a rear screw 68 extending through the case 36. Screws 66, 68 form the axis about which the recoil wheel 62 turns freely during operation of the device. A return spring 70 in the recoil wheel 62 supplies the necessary force to recoil the cord 24 when the pull force on the handle 22 is released.

A graduated scale 72 is applied to the top of the case 36 opposite the detent assembly 28 and slider bar 30. Scale 72 is used to calibrate the resistance applied to the cord 24 at various different positions of the detent assembly 28. A hook 74 or any other fastening mechanism can be used to attach the housing 32 to a support, as required during operation.

Operation

Figure 3:
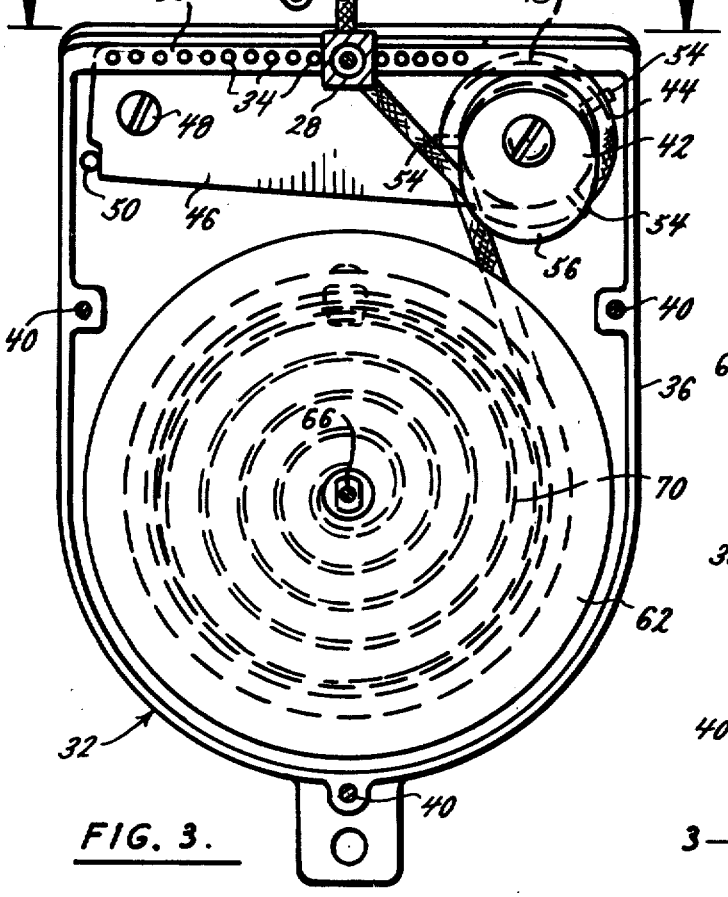
FIG. 3 is taken along the lines 3—3 in FIG. 2 and is a cut away front view of the device.

The exercise device 20 is operated by first attaching the housing 32 to a convenient support by use of the hook 74. The user then grasps the handle 22 with the foot or hand and pulls or pushes the handle to extract cord 24 and begin the exercise. The force exerted on the cord 24 has a vertical component, as viewed in FIG. 3, at every position hole 34 for the detent assembly 28. The vertical force component causes the support arm 46 to rotate about the screw 48 and squeeze the first loop 44 of cord 24 between the spool 42 and the top of the case 36 or slider plate 60. Only the first loop 44 is squeezed as the second and third loops 45 slide in the recess slot or slots 58 which diminish their upward extension. The contact forces of squeezing action create frictional forces between the cord 24, slider plate 60, and the spool 42, distal to the squeeze point, to resist the pull force. As the detent assembly 28 is moved along the slider bar 30 to a position hole 34 further away from the spool 42, the angle between the cord 24 and the top of the housing case 36 decreases thereby reducing the vertical component of the pull force, the squeezing of the cord 24 between the spool 42 and the top of the case 36 or slider plate 60, and the resistance applied to the cord 24. This adjustment is the fine adjustment for the exerciser 20.

In addition, the loop or loops 44 and 45 of cord 24 about the spool 42 oppose the movement of the cord 24 due to their capstan friction effect. The capstan friction of loops 44 and 45 is independent of the sliding friction caused by the cord 24 rubbing against the case 36 and is a function of the number of loops 44 and 45 of cord 24 about the spool 42. If one loop 44 is used, less pull force is required to extract the cord 24 from the housing 32 than if more loops 44 and 45 are used. By selecting the correct size spool 42, each additional loop 45 will add enough resistance that a continuous transition is made from the highest adjustment of the detent assembly 28 with one loop 44 to the lowest adjustment of the detent assembly 28 at two loops 44 and 45. Similarly, the transition would be continuous between two and three loops. A spool diameter of about one inch has been used successfully with a support arm of about four inches in length to give a wide range of adjustment.

As the handle 22 is pulled, the cord 24 plays out from the recoil wheel 62 until the desired exercise stroke has been completed, usually less than the full length of the cord 24. The user then discontinues exerting the pull force which allows the return spring 70 to start the recoiling process. The recoil force on the cord 24, looped around the spool 42, retracts the support arm 46 and causes it to rotate about its screw 48. By retracting, the support arm 46 pulls the loop 44 of cord 24 away from the top of the case 36 or slider plate 60 and reduces the sliding friction. The return spring 70 is of sufficient strength to overcome the remaining friction and wind the cord 24 back around the recoil wheel 62 thusly returning the handle 22 to the start position of the exercise stroke or to the top of the housing 32 if the exercise is completed.

It can be appreciated by one skilled in the art that various modifications can be made to applicant's device without departing from the spirit and scope of the invention. Applicant's invention is to be limited only by the scope of the appended claims and not by the embodiments disclosed herein for purposes of illustration.

What is claimed is:

1. An exercise device comprising a housing consisting of a case and a removable front cover, a cord, a recoil wheel mounted in the housing for storing the cord and retracting it upon release of the pull force, a support arm pivotally mounted to the case, the case having a pin located to limit the support arm, a spool, the support arm having a free end with said spool mounted thereon, the cord having at least one loop around the spool, the spool having at least one recess slot to accept a cord loop and at least one guide pin extending radially outwardly from the spool, the spool having a retaining plate at an edge of the spool; the case having a cord guide and a support for the cord guide, the cord guide having selectively movable means to position the guide along the support, the guide having detent means to selectively fix the guide at a plurality of locations along the support and a graduated scale means associated with the detent means for calibrating sliding resistance, the cord having a handle attached to an end of the cord for applying force to the cord; the case having means to mount the device on a support.

2. An exercise device having means mounting a cord within the device for selective movement of the cord into and out of the device, the device having further means to resist movement of the cord as the cord moves out of the device, said last mentioned means including spool means about which the cord may be wound and lever means supported in the device and cooperating with the spool means for pivotal movement thereof so as to force the cord on the spool means against the device.

3. The device of claim 2 wherein the device has a separate means to resist movement of the cord out of the device.

4. The device of claim 2 further comprising means in the spool means to recess a part of the cord wrapped around it.

5. The device of claim 2 wherein the device has selectively adjustable means to selectively adjust the sliding friction to the cord.

6. The device of claim 5 wherein the adjustment means includes a guide and means to position the guide a variable distance from the spool means.

7. The device of claim 2 wherein the device has means to retract the cord from a position outside of the device to a position inside the device.

8. The device of claim 2 wherein the spool means has means to allow selective adjustment of the amount of cord received around said spool means.

9. An exercise device having a cord, a housing and means mounting the cord within the housing for selective movement of the cord into and out of the housing, the device having a further means to impinge the cord against the housing to selectively vary the frictional resistance of the cord as the cord is moved out of the housing, the impinging means including a cooperating pivoted level means having a spool thereon which supports the cord.

10. The device of claim 9 further comprising means to reduce the sliding friction when the cord is moved into the device.

* * * * *